US005134559A

United States Patent [19]

Ruskin

[11] Patent Number: 5,134,559

[45] Date of Patent: Jul. 28, 1992

[54] LAMPSHADE AND METHOD OF MAKING SAME

[76] Inventor: Thomas R. Ruskin, 20 Constellation Wharf, Charlestown, Mass. 02129

[21] Appl. No.: 423,012

[22] Filed: Oct. 18, 1989

[51] Int. Cl.[5] ..... F21V 11/00

[52] U.S. Cl. ..... 362/351; 362/357; 362/361

[58] Field of Search ..... 362/351, 355, 356, 357, 362/358, 361

[56] References Cited

U.S. PATENT DOCUMENTS

| | | | |
|---|---|---|---|
| 2,111,844 | 3/1938 | Davidson | 362/351 |
| 2,498,097 | 2/1950 | Scherer | 362/351 |
| 3,065,531 | 11/1962 | Rosenthal | 362/358 |
| 3,161,358 | 12/1964 | Gottlieb | 362/357 |
| 3,385,963 | 5/1968 | Washick | 362/357 |
| 3,778,611 | 12/1973 | Burridge et al. | 362/351 |
| 4,068,120 | 1/1978 | Throckmorton et al. | 362/351 |
| 4,539,631 | 9/1985 | Lieverman | 362/355 |
| 4,772,992 | 9/1988 | Tang | 362/358 |

OTHER PUBLICATIONS

Fishburn, Angela, The Batsford Book of Lampshades, B. T. Batsford, London, 1984.

Rourke, Margaret, Lampshades-Simple & Advanced, Mills & Boon Limited, London, 1960.

Fishburn, Angela, Making Lampshades, Drake Publishers, Inc. New York 1975.

Doeser, Linda, Lampshades to Make, Domus Books, 1976.

*Primary Examiner*—Stephen F. Husar
*Assistant Examiner*—D. M. Cox
*Attorney, Agent, or Firm*—Morse, Altman, Dacey & Benson

[57] ABSTRACT

An novel lampshade and process of its manufacture are disclosed. The lampshade is characterized by an understated elegant look. The lampshade looks as if stretched on the outside, and features a contoured lining. Essentially, the lampshade comprises a cover that serves as a rigid shell that defines upper and lower perimeters. The lining is secured at the perimeters to the shell and is separated therefrom by a form.

10 Claims, 5 Drawing Sheets

LAMPSHADE AND METHOD OF MAKING SAME

BACKGROUND OF THE INVENTION

1. Field of the Invention

The present invention relates generally to lampshades and methods of making them and, more particularly, to an improved lampshade and a novel process of manufacturing the same.

2. The Prior Art

Lighting a home or an office must be safe, convenient, efficient and ought to suit the functions of the room. Lighting brings a home or an office to life since color is only present when and where there is light. Colors and textures are affected by the intensity and color temperature of light available. The textures of furnishings, pictures and other objects in theorem can be emphasized or subdued by the choice of lighting. Light from a lamp can be warm or cool, bright or dim, depending on the type of lampshade employed. Lampshades are lighting accessories that re both functional and decorative, so that they play an important part in the appearance of a room. A lampshade demands a high standard of workmanship and a meticulous attention to detail, since any defects and/or imperfections can become immediately apparent when the lamp is on. Further, fashions in lampshades change constantly, so that the manufacturing process must be both economical and easily adapted for change.

Of the several known methods for producing lampshades, the following three can be mentioned. The first method involves hand-sewing, which produces shades that are beautifully-carded, smooth-paralleled, carefully-stretched, and fully lines. Being labor intensive, hand-sewn lampshades are among the most expensive. A second metro involves less handwork, for example employing jigs for retaining the components, machinery for stretching the fabrics, and special sewing machines for stitching the fabrics, linings and trimmings. This technique, being less labor intensive, is less expensive, but results in lampshades that often lack the aesthetic appeal of hand-sewn lampshades. A third method, inter alia, relies more explicitly on shaping fabrics with the aid of a wire cage, and applying straps or pleats to mask or hide supporting struts.

Such shortcomings are pronounced in the case of the so-called coolie shade and the like, which typically feature a smooth, tight, conical outer cover and a bell-shaped lining. In the past, high quality coolie shades have been hand-sewn because independent stretching and shaping of the cover and the lining have been difficult to achieve. Such a construction, aside from being hand-crafted, also has involved pleats, wrangles and a multiplicity of seams and treatments, for masking the struts of associated wire cages. Hence, in particular, an economical practical, highly aesthetic version of the coolie-type lampshade, i.e., a lampshade having a taut conical cover and a bell-shaped lining, has eluded workers in the field.

SUMMARY OF THE INVENTION

It is a principal object of the present invention to overcome the above disadvantages by providing an improved lampshade, including a coolie-type lampshade, and an economical process of fabricating the same. More specifically, it is an object of the present invention to provide a lampshade having a novel elegant look that is provided by the unbroken or continuous geometry of the outer surface of a relatively stiff shell, and the soft contours of an inner fabric lining that are determined by the upper and lower perimeters of the shell to which the upper and lower borders of the lining are attached, and the tailoring and composition of the fabric.

Essentially the lampshade of the present invention has a configuration that is defined by a pair of perimeters that are concentrically spaced form each other in parallel planes. In one form these perimeters are established by a pair of mounting rings, at least one of which is provided with a fitting for positioning the lampshade on a support. Mounted to and between the pair of mounting rings are an outer cover and an inner lining. The cover, which constitutes a semi-rigid shell that extends between the aforementioned perimeters, typically is composed of a laminate having an exterior cloth stratum and an interior plastic stratum. The lining is stretched between the perimeters and is shaped at least at the lower perimeter by an annular form, the under side of which is convex in cross-section. The inner stratum of the laminate is a relatively stiff shell that ensures rigidity and integrity of the lampshade configuration. The upper portion of the lining is scrolled outwardly, downwardly and reversely to form a welt which is cemented at the upper rim of the outer border of the cover. The lower portion of the lining is scrolled outwardly, upwardly and reversely to form a welt which is cemented at the lower rim of the outer border of the cover. The resulting lampshade provides an aesthetic visual effect that results from a novel interaction between the geometry of the lampshade and the interior and exterior luminosity by which it is observed.

Other objects of the present invention will in part be obvious and will in part appear hereinafter.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

Figure 2:
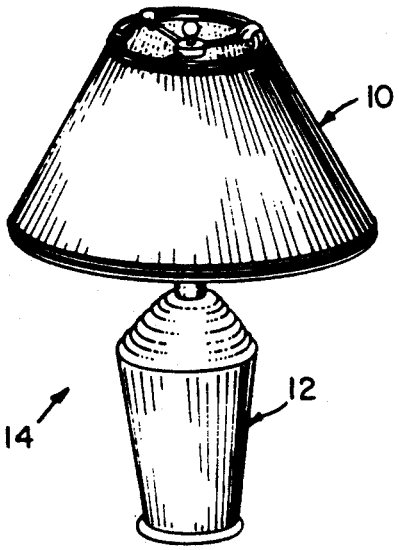
FIG. 2 is a perspective view of a lamp featuring the lampshade of FIG. 1.
Figure 1:
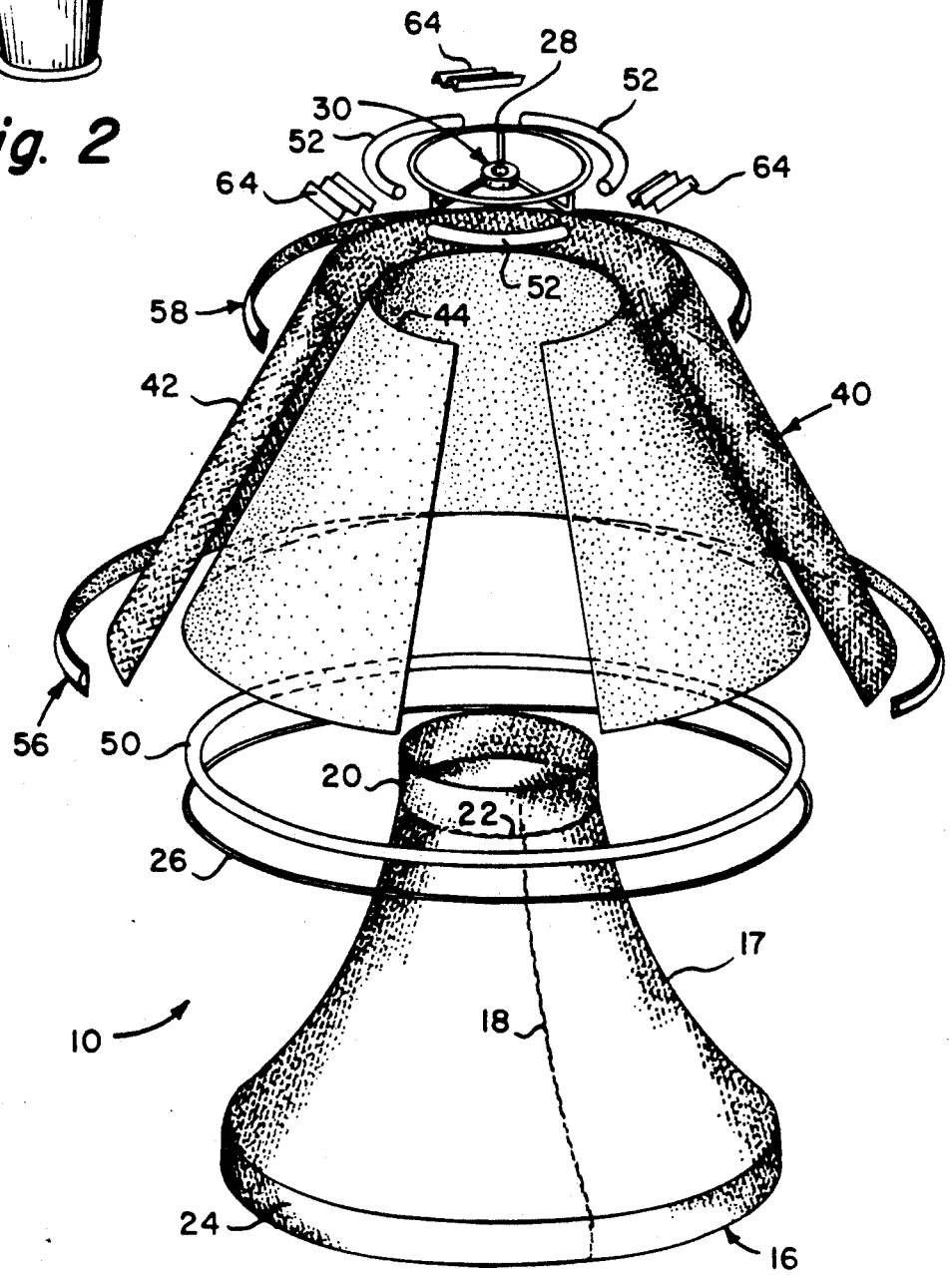
FIG. 1 is is an exploded perspective of an embodiment of a lampshade according to the invention.

In general, a lampshade 10 having a construction according to the invention is illustrated in exploded perspective view in FIG. 1. The illustrated lampshade 10, which is of the coolie shape type, is shown in FIG. 2 as being mounted to a base 12 to form a table lamp 14. The lampshade 10 of the invention is characterized by an understated element look, by virtue of the interacting appearance of its cover and lining, which results for the construction now to be described.

As may be observed, the lampshade 10 of the invention looks as if it were stretched on the outside, as expansive lamps of like appearance in fact are. Lampshade 10, furthermore, does feature a lining 16, bell-shaped as at 17, and stitched together along a vertical line 18. Lining 16, as shown, is formed of two parts, an upwardly diverging skirt 20 and a downwardly diverging skirt 24, stitched together along a horizontal annular seam 22.

Figure 11:
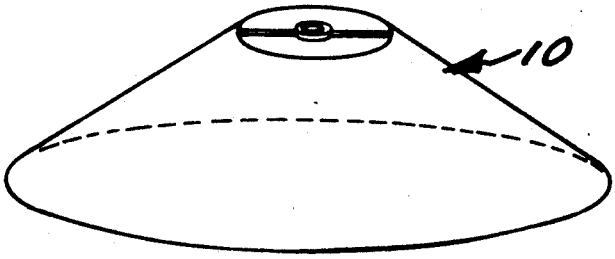

Basically, the lampshade 10 of the invention comprises a frame including a pair of mounting rings 26 and 28 concentrically spaced from each other in parallel geometrical planes, and a fitting 30, secured to the upper one of the pair of mounting rings 26 and 28. The illustrated fitting 30 is of a 3-arm pendant variety. In alternative embodiments, the fitting 30 also is formed as a 2-arm pendant, a wire drop pendant, a strip-flush pendant, a bulb clip, a candle cup, or a reversible gimbal type, all as known. It will be observed that the illustrated pair of mounting rings 26 and 28 are designed to form a coolie shape of the type shown in FIG. 11. Accordingly, the lower of the pair of rings 26 and 28 is formed with a larger diameter than the upper one.

A laminate 40 is designed to be circumferentially secured to the pair of rings 26 and 28, forming thereby the shade proper of the lampshade 10. The laminate 40 is formed of an external cloth structure 42, secured, preferably by a suitable transparent adhesive 43, to an internal plastic structure 44. The securing of the two sheets 42 and 44 to each other so as to form the laminate 40, as shown, is effected in the flat position, after the respective sheets 42 and 44 have been cut and with the transparent adhesive 43 applied to the sheet 42, by an appropriate cold or hot press operation. It will be noted, observe FIG. 5, that the laminate 40 is formed with a semi circular bottom edge 46, a semi-circular top edge 48 and straight edges 49, 49 connecting with the edges 46 and 48. These edges 46, 48 and 49, 49 are formed of the cloth structure 42 only. The adhesive layer 43 can be conveniently spread on one side of the sheet of cloth 42, or if desired, the sheet of cloth 42 can be impregnated, as by being dipped into a liquid adhesive designed to form the layer 43 when dry.

Figure 5:
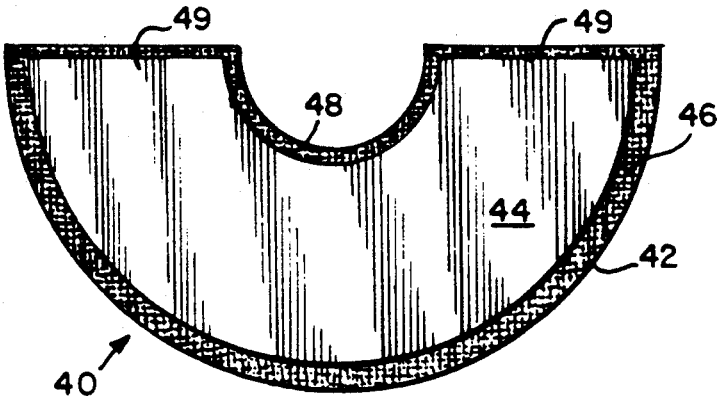
FIG. 5 is a plan view of an operative part of the lampshade of FIG. 1 in flat, spread out position.
Figure 6:
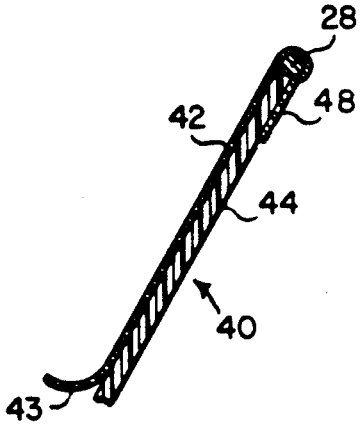
FIG. 6 is a fragmentary vertical section, on an enlarged scale, illustrating how the part of FIG. 5 is secured to another operative part of the lampshade.

With the laminate 40, cut and assembled as shown in FIG. 5, the same is folded into a cone, i.e., the coolie-shape, with the adjacent straight edges 49, 49 placed in overlapping relation and adhered to one another in a way that the straight edges of the sheet of plastic 44 either are abutting or also are overlapping slightly. The now cone-shaped laminate 40 constitutes a semi-rigid or rigid shell, i.e. a substantially rigid shell, that is then secured to the pair of mounting rings 26 and 28 by first folding the bottom edge 46 over the ring 26 to form a welt, followed by folding the top edge 48 over the ring 28 to form another welt, and securing the folded-over edges 46 and 48 to the inside surface of the sheet of plastic 44, as illustrated in FIG. 6.

Figure 3:
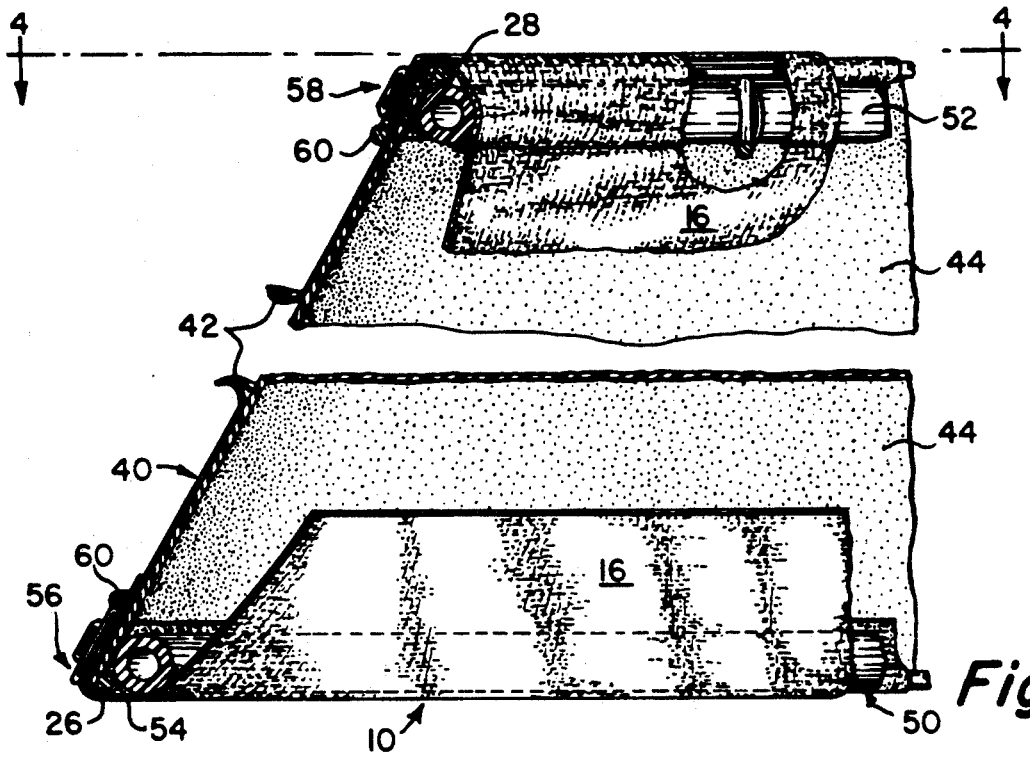
FIG. 3 is a fragmentary vertical section on an enlarged scale, with parts broken away, of the lampshade of FIG. 2.
Figure 8:
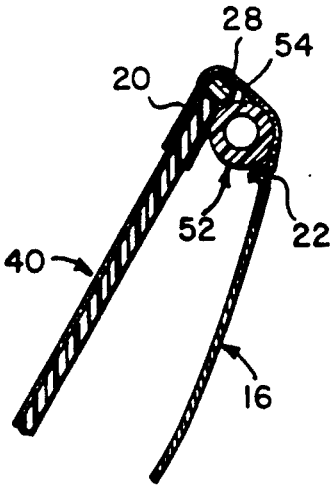
FIG. 8 is a view similar to FIG. 6 but illustrating the part of FIG. 7 as also secured thereto.

Forms or other spacer means 50 and 52, each provided with a curved profile 54, are mounted adjacent the pair of mounting rings 26 and 28, observe FIG. 3. As shown, each of the forms 50 and 52 is constructed from a flexible tube, which is secured in place preferably by being glued in place, observe FIG. 8. As shown, the form 50 is constructed from a single tubular element whose ends are glued to one another. As shown, form 52, however, is constructed in segments to seat within the illustrated 3-arm pendant fitting 30. The gluing preferably is effected by the same transparent adhesive which is used to impregnate the sheet of cloth 42. In the alternative, an adhesive layer also can be provided about at least a part of the surface of the forms 50 and 52 which are designed to come into contact with the reversely folded edges 46 and 48. In either event, the forms 50 and 52 are pressed and thus anchored into place. Forms 50 and 52 serve to space the lining from the laminate to define the configuration of the lining.

Figure 7:
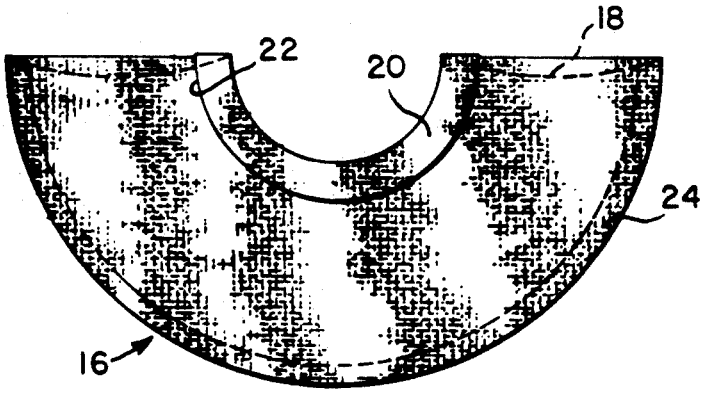
FIG. 7 is a view similar to FIG. 5 but showing another operative part of the lampshade of FIG. 1.
Figure 8A:
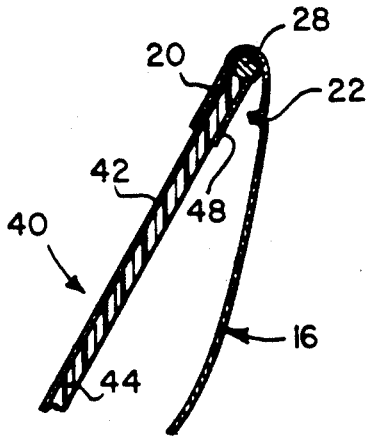
FIG. 8A is a view similar to FIG. 8 but illustrating a different embodiment of lampshade construction.

The bell-shaped lining 16, which previously has been sewn into the shape as illustrated in FIG. 1, is thereafter secured about the mounting rings 26 and 28 and the forms 50 and 52. In order to attach the lining 16 to the shell, the borders of the skirt 20 and the skirt 24 are impregnated with a suitable transparent adhesive, note also FIG. 7. The impregnated skirts 20 and 24 are, respectively, folded over both the curved profiles 54 of the forms 50 and 52 as well as over the pair of mounting rings 26 and 28 and respectively secured to the outside edges of the laminate 40, note FIG. 8. In an alternative embodiment, form 52, but not form 50, is omitted from the structure of the lampshade 10. Such an embodiment is illustrated at 40*a* in FIG. 8A in relation to elements 16*a*, 20*a*, 22*a*, 28*a*, which correspond to their counterparts in FIG. 8.

Figure 4:
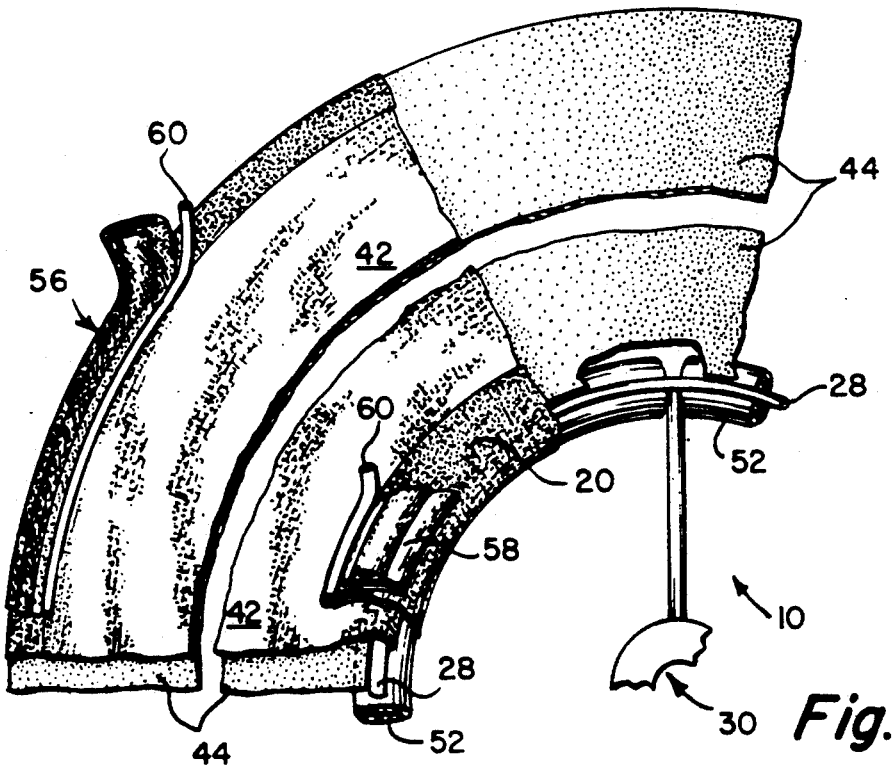
FIG. 4 is a plan view along the line 4—4 of the lampshade of FIG. 3.

Once the lining 16 is properly secured in place in between and to the parallel spaced pair of mounting rings 26 and 28, the lining 16 is further secured in place by trimmings 56 and 58. Although the trimmings 56 and 58 can take any appropriate form and shape, preferably they are formed as tapes of cloth, note FIGS. 3 and 4. The tapes of cloth, in various alternative embodiments, are folded over one another and comprise more than one layer, with each layer being of different texture and/or color, or featuring varying patterns or combinations of patterns. Thus the function of the trimmings 56 and 58 is two-fold: they serve to anchor both the lining 16 and the laminate 40 in and to the pair of mounting rings 26 and 28; and additionally, they serve a decorative purpose. In an alternative embodiment, the trimmings 56 and 58 also include a decorative ribbon 60, of the same or a different color and preferably mounted adjacent the tapes and forming a part thereof prior to their being mounted to the outside of the laminate 40.

Figure 10:
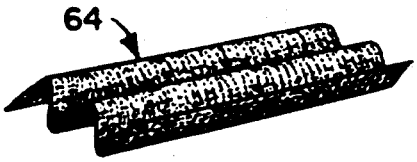
FIG. 10 is a perspective view of an operative part of the structure illustrated in FIG. 9.
Figure 9:
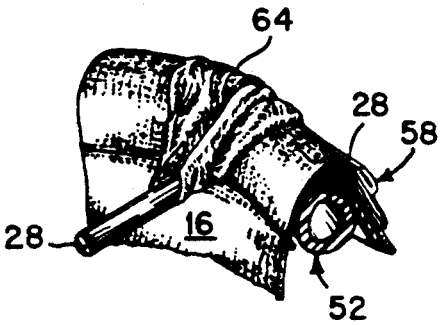
FIG. 9 is a fragmentary perspective view, on an enlarged scale, illustrating the securing of the lampshade of FIGS. 1 and 2 to its fitting.

In order further to secure the lampshade 10 of the invention to the fitting 30, herein illustrated as a 3-arm pendant, a plurality of folded pieces of cloth 64, as many in numbers as there are arms of the particular fitting used, are employed, note FIGS. 9 and 10. The respective pieces of cloth 64 are first folded and then wrapped about each of the respective arms of the particular fitting, as illustrated in FIG. 9. The free ends of the pieces 64 preferably are secured, as by gluing, to the outside of the collar 20 and before the top trimmings 58 are secured in place.

The frame of the lampshade 10 of the invention, comprising the pair of mounting rings 26 and 28 and the fitting 30, are formed either of metal or a dimensionally stable plastic. The fabric 42 of the laminate 40 preferably is formed of one of a group consisting of silk, wild silk, shunting, cotton, satin, crepe de China and crepe-backed satin. The plastic preferably is composed of a clear or translucent polymer so as to allow maximum light to penetrate through the laminate 40. If the laminate 40 is formed of silk, the use of clear plastic allows the viewing of the pinholes in the silk material, giving rise to a pleasing appearance for the shade 10. The fabric of lining 16 preferably is composed of a member of the group consisting of silk, cotton, rayon, dupion, jap silk, silk shunting, silk chiffon, cotton chiffon and polyester-cotton.

In an alternative embodiment, the shell of the cover, together with the lower form which is inwardly directed as a downward ridge in cross-section, are cast in a die, and thereafter are faced with a fabric. In this embodiment the upper and lower perimeters of the shell are established inherently and no discrete mounting rings or forms are required. In another embodiment, the shell of the cover is constructed from a stiff cardboard.

Figure 12:
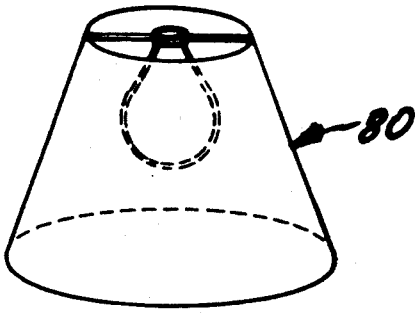
FIGS. 11 through 16 illustrate several shapes of lampshades, including fittings, to each of which the invention is equally applicable.
Figure 13:
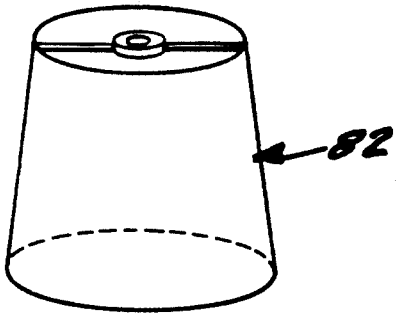
Figure 14:
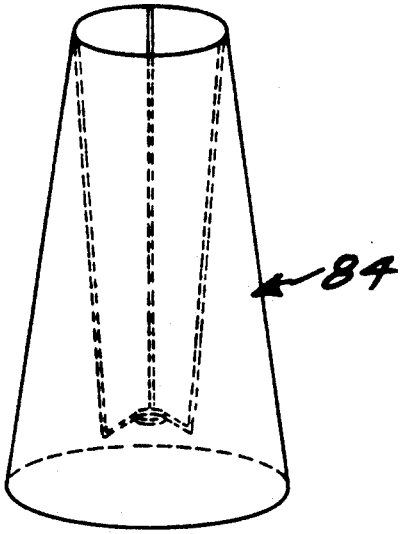
Figure 15:
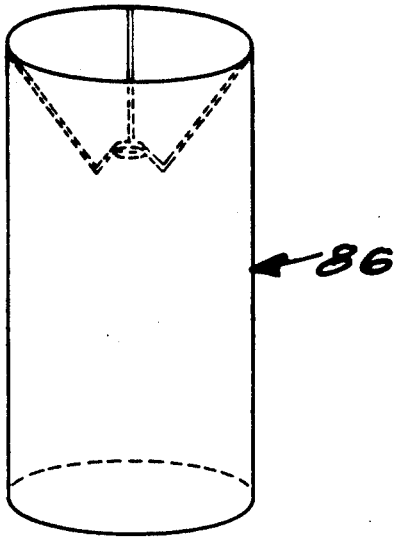
Figure 16:
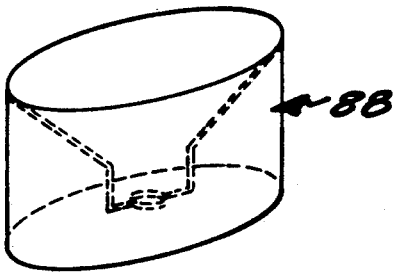

By selecting the respective diameter sizes for the respective pair of rings 26 and 28, the shape of a particular lampshade can be determined. For example, lampshade 10 of FIGS. 1–4 is of the coolie type exaggeratedly illustrated in FIG. 11. FIGS. 12–16 illustrate other known shapes of lampshades embodying the present invention. Specifically: FIG. 12 illustrates an empire shape 80 with a bulb clip fitting; FIG. 13 illustrates a drum shape 82 with a hanging fitting; FIG. 14 illustrates an American drum shape 84 with a strip pendent fitting; FIG. 15 illustrates a cylinder shape 86 with a hanging fitting; and FIG. 16 illustrates an oval shape 88 with a reversible fitting.

OPERATION

The following steps and characteristics explain the illustrated process of the present invention and the operation of the resulting product. The process of making a lampshade comprises: providing a frame including a pair of spaced rings and a fitting secured to one of the pair of spaced rings; providing a laminate; cutting the laminate to size; forming the sized laminate into the desired shape and securing it to and between the pair of spaced rings; mounting a form having a curved profile adjacent at least one of the pair of spaced rings; providing a lining; and securing the lining to the pair of spaced rings while enveloping the lower form. In one embodiment, the laminate is shaped from a sheet of cloth and a sheet of plastic. The lining is shaped from a pliable material which is cut to size and stitched to provide a bell shape on the inside surface of the lampshade. As shown, securing the laminate and the lining to the pair of spaced rings is effected by folding the respective edges thereof over the pair of spaced rings, gluing the folded edges in place, and gluing a tape over the folded edges. As shown, trimmings are provided as tapes circumferentially secured to the laminate in the vicinity of the pair of spaced rings. In one embodiment, the tapes are decorated with ribbons, at least one of which is of a color different from the laminate. In one embodiment, one of the ribbons is secured to the tapes by being glued thereto. In one form securing the laminate to and between the pair of spaced rings is effected by tapes overlapping the edges of the laminate, folded over the pair of spaced rings, and adhering to the inside of the laminate. The operation of the resulting lamp is such that moire or other interesting optical effects resulting from the optical interaction between the facing fabric of the cover and the fabric lining is not inhibited by the clear plastic shell.

Thus it has been shown and described an improved lampshade featuring a stretched, elegant look and a novel process of its manufacture, which process and lampshade satisfy the objects and advantages set forth above.

Since certain changes may be made in the present disclosure without departing form the scope of the present invention, it is intended that all matter described in the foregoing specification or shown in the accompanying drawings, be interpreted in an illustrative and not in a limiting sense.

What is claimed is:

1. A lampshade comprising:

(a) a structure including an upper perimeter and a lower perimeter that are fixed with respect to each other;

(b) said upper perimeter and said lower perimeter defining a conical shape that diverges downwardly;

(c) a fixture for securing said lampshade to a lamp base secured to one of said upper perimeter and said lower perimeter for connection to a support;

(d) a rigid outer shell conforming to said conical shape;

(e) a shaper ring affixed to said lower perimeter; and (f) a cloth lining stretched between said upper perimeter and said shaper ring within said shell;

(g) said cloth lining being flared outwardly as it extends downwardly so that the bulk of the area of said lining is spaced from said shell.

2. A lampshade comprising:

(a) a frame including a pair of spaced perimeters and a fitting secured of one of said pair of spaced perimeters;

(b) a self-supporting structure forming the shade of said lampshade circumferentially secured to said pair of spaced perimeters and keeping said perimeters in said spaced-apart relationship;

(c) a lining secured to said pair of spaced perimeters internally of said self-supporting structure, said self-supporting structure comprising an exterior cloth stratum and an interior rigid plastic stratum; and (d) means mounted adjacent at least one of said pair of spaced perimeters and interposed between said self-supporting structure and said lining, said means having a curved profile in cross section;

(e) one of said means having said curved profile defining at least one of a pair of spacer members to space said lining from said self-supporting structure.

3. The lampshade of claim 2 wherein said lining is made from one of a group consisting of: silk, cotton, rayon, dupion, jap silk, silk shantung, silk chiffon, cotton chiffon and polyester-cotton sheeting.

4. The lampshade of claim 2 further including trimmings circumferentially secured to said laminate in the vicinity of said pair of spaced perimeters, and wherein said spacer members are plastic tubes secured in place by cement.

5. A process of making a lampshade comprising:

(a) providing a frame consisting of a pair of spaced perimeters and a fitting secured adjacent one of said pair of spaced perimeters;

(b) providing a self-supporting structure for forming the shade of said lampshade comprising an exterior cloth stratum and an interior rigid plastic stratum;

(c) cutting said self-supporting structure to size;

(d) forming said sized self-supporting structure into desired shape and securing it to and between said pair of spaced perimeters;

(e) mounting a means having a curved profile adjacent at least one of said pair of spaced perimeters;

(f) providing a lining; and (g) securing said lining to said pair of spaced perimeters while enveloping said means having said curved profile so as to space said lining from said self-supporting structure.

6. The process of claim 5 wherein said lining is formed of a pliable material which is cut to size and stitched to form a ell shape on the inside surface of said self-supporting structure, and wherein said means having said curved profile is formed of at least one of a pair of spacer members.

7. The process of claim 5 wherein said securing said laminate to and between said pair of spaced rings is effected by tapes overlapping the edges of said laminate and being folded over said pair of spaced rings and adhering to the inside of said laminate, and wherein the securing of said laminate, said means having said curved profile and said lining is effected by gluing.

8. A process of making a lampshade comprising:

(a) providing a frame consisting of a pair of spaced rings and a fitting secured to one of said pair of spaced rings;

(b) providing a self-supporting structure for forming the shade of said lampshade and comprising an exterior cloth stratum and an interior rigid plastic stratum;

(c) cutting said self-supporting structure to size;

(d) forming said sized self-supporting structure into desired shape and securing it to and between said pair of spaced rings;

(e) mounting a means having a curved profile adjacent at least one of said pair of spaced rings;

(f) providing a lining of flexible material;

(g) securing said lining to said pair of spaced rings internally of said self-supporting structure while enveloping said means having said curved profile so as to space said lining from said self-supporting structure;

(h) said securing said exterior cloth stratum of said self-supporting structure and said lining to said pair of spaced rings being effected by folding the respective edges thereof over said pair of spaced rings, gluing said folded edges in place, and gluing a tape over said folded edges; and (i) providing trimmings in the form of tapes circumferentially secured to said self-supporting structure in the vicinity of said pair of spaced rings.

9. The process of claim 8 wherein said tapes are decorated with ribbon, at least one of which is of a color different from said laminate; and wherein one of said ribbons is secured to said tapes by being glued thereto.

10. A lampshade comprising:

(a) an outer cover and an inner lining;

(b) said outer cover extending between an upper annular perimeter and a lower annular perimeter in planes spaced from each other;

(c) said cuter over comprising a self-supporting structure forming the shade of said lampshade and consisting of an inner synthetic plastic, dimensionally table shell and an outer fabric facing contiguous therewith;

(d) a lower annular form in contiguity with said lower perimeter and presenting a downwardly presented surface that is convex in axial cross-section;

(e) said lining having an upwardly directed skirt and a downwardly directed skirt, meeting at a waist;

(f) said waist being disposed at said upper perimeter;

(g) said upwardly directed skirt being scrolled outwardly above and beyond said upper perimeter to provide an upper welt;

(h) said upper welt being fixed to the upper border of the outer surface of said cover;

(i) the lower extremity of said downwardly directed skirt being scrolled outwardly below and beyond said lower perimeter and in contact with said convex surface of said form to provide a lower welt, said convex surface of said lower annular form designed to space said lining from said self-supporting structure;

(j) said lower welt being fixed to the lower border of the outer surface of said cover;

(k) said synthetic plastic being transparent; and (l) said downwardly directed skirt being outwardly flared and said upwardly directed skirt being outwardly flared.

* * * * *